US009995560B2

(12) United States Patent
Zörkler et al.

(10) Patent No.: US 9,995,560 B2
(45) Date of Patent: Jun. 12, 2018

(54) IGNITION DEVICE

(71) Applicant: TDW Gesellschaft für verteidigungstechnische Wirksysteme mbH, Schrobenhausen (DE)

(72) Inventors: Gerhard Zörkler, Aresing (DE); Johann Florian, Schrobenhausen (DE)

(73) Assignee: TDW Gesellschaft für verteidigungstechnische Wirksysteme mbH, Schrobenhausen (DE)

( * ) Notice: Subject to any disclaimer, the term of this patent is extended or adjusted under 35 U.S.C. 154(b) by 0 days. days.

(21) Appl. No.: 15/217,565

(22) Filed: Jul. 22, 2016

(65) Prior Publication Data

US 2017/0023338 A1 Jan. 26, 2017

(30) Foreign Application Priority Data

Jul. 23, 2015 (DE) ..... 10 2015 009 576

(51) Int. Cl.
*F42B 3/12* (2006.01)
*F42B 3/14* (2006.01)

(52) U.S. Cl.
CPC ..... *F42B 3/121* (2013.01); *F42B 3/12* (2013.01); *F42B 3/14* (2013.01)

(58) Field of Classification Search
CPC .. F42B 3/12; F42B 3/121; F42B 3/124; F42B 3/13; F42B 3/14
USPC ..... 102/202.5, 202.7, 202.9, 202.11, 275.11
See application file for complete search history.

(56) References Cited

U.S. PATENT DOCUMENTS 4,471,697 A 9/1984 McCormick et al.
4,928,595 A * 5/1990 Weingart ..... F42B 3/124 102/202.5
5,080,016 A 1/1992 Osher
5,347,929 A * 9/1994 Lerche ..... E21B 43/1185 102/202.14
6,385,031 B1 * 5/2002 Lerche ..... E21B 43/1185 200/61.08
6,386,108 B1 * 5/2002 Brooks ..... E21B 43/1185 102/202.5
6,502,512 B2 1/2003 Riviere et al.
6,553,911 B1 * 4/2003 Walker ..... F42B 3/14 102/202.7

(Continued)

FOREIGN PATENT DOCUMENTS

DE 10 2011 108 000 1/2013
DE 10 2014 010 179 3/2015

(Continued)

OTHER PUBLICATIONS

Extended European Search Report for Application No. 16001468 dated Nov. 9, 2016.

(Continued)

*Primary Examiner* — Bret Hayes
(74) *Attorney, Agent, or Firm* — Jenkins, Wilson, Taylor & Hunt, P.A.

(57) ABSTRACT

The ignition device according to the present disclosure implements in a reliable manner a one-time transient switching process for high voltages (>1.5 kV) and high currents (>3 kA) in combination with a minimal space requirement, maximum environmental durability and at the same time low cost expenditure by integrating the essential components on a flexible printed circuit system.

20 Claims, 4 Drawing Sheets

(56) References Cited

U.S. PATENT DOCUMENTS

| | | | |
|---|---|---|---|
| 8,281,718 | B2 | 10/2012 | Rice |
| 2003/0200890 | A1 | 10/2003 | Reynolds et al. |

FOREIGN PATENT DOCUMENTS

| | | | |
|---|---|---|---|
| EP | 1 172 628 | A2 | 1/2002 |
| WO | WO 89/10529 | A1 | 11/1989 |
| WO | WO 2011/160099 | A1 | 12/2011 |

OTHER PUBLICATIONS

German Office Action for Application No. 102015009576 dated Feb. 15, 2016.

* cited by examiner

IGNITION DEVICE

CROSS-REFERENCE TO RELATED APPLICATION

This application claims priority to German patent application, DE 10 2015 009 576.5, filed Jul. 23, 2015, the entire disclosure of which is incorporated by reference herein.

TECHNICAL FIELD

The present disclosure concerns an ignition device for an explosive charge of an active body comprising at least one ignition circuit and a device for transmitting the completed initiation.

BACKGROUND

Such ignition devices, which generally comprise at least one ignition circuit with an energy storage device (capacitor) and a switch, with which the stored energy is used to trigger a component by closing the switch.

An EFI ignition module that operates according to the principle has become known from DE 10 2011 108 000 A1, wherein ultimately a synthetic pellet is ignited. An ignition bridge that is provided in the ignition module is suddenly evaporated by feeding in electrical energy from a capacitor and thereby a small part is blasted out of the film that is disposed above the ignition bridge using the barrel that is disposed above the film. The part has sufficient shock wave energy for triggering the synthetic pellet.

SUMMARY

Since no further instructions are to be obtained from the document regarding ways to further reduce the size of an ignition module, an object arises of finding a design that enables a further reduction of the structural volume without restricting the required discharge currents (>1000 A) and voltages (>1 kV).

This object is achieved according to the present disclosure by implementing the ignition device as a compact component that comprises two thin, strip-shaped metal layers that are separated from each other by an electrically insulating plastic layer. Further embodiments of the present disclosure can be found in the secondary claims.

Particular advantages of the ignition device include that first a considerable reduction of the required space is achieved compared to the known embodiment. Connected therewith, no small reduction of the costs of manufacture is also achieved. Furthermore, the scatter of the characteristic values is reduced and the long-term stability is considerably increased. Regarding the required supply voltage, it is positive to note that in no case does the supply voltage have to be increased compared to the prior art, as no particular spark gaps have to be used.

BRIEF DESCRIPTION OF THE DRAWINGS

Exemplary embodiments of the present disclosure are represented schematically in a simplified form in the figures of the drawing and are described in detail below. In the figures.

DETAILED DESCRIPTION

Figure 1A:
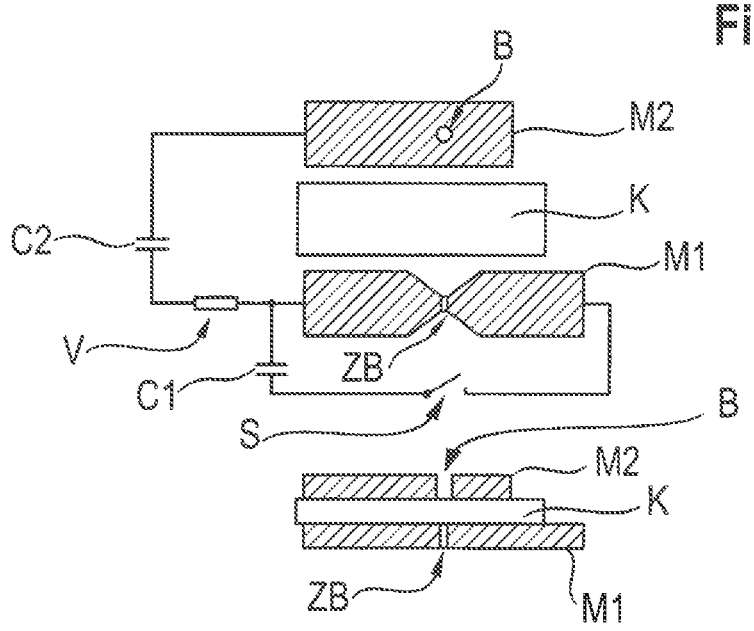
FIG. 1*a*: shows a first embodiment for the initiation of a low impedance load in the rest phase.
Figure 1B:
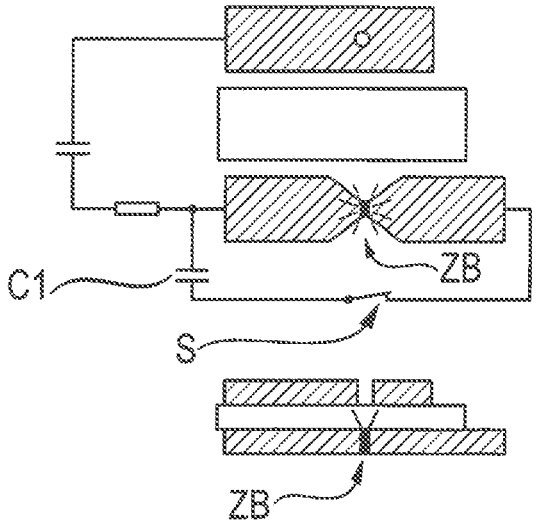
FIG. 1*b*: shows the ignition device of FIG. 1*a* in the first activation phase.
Figure 1C:
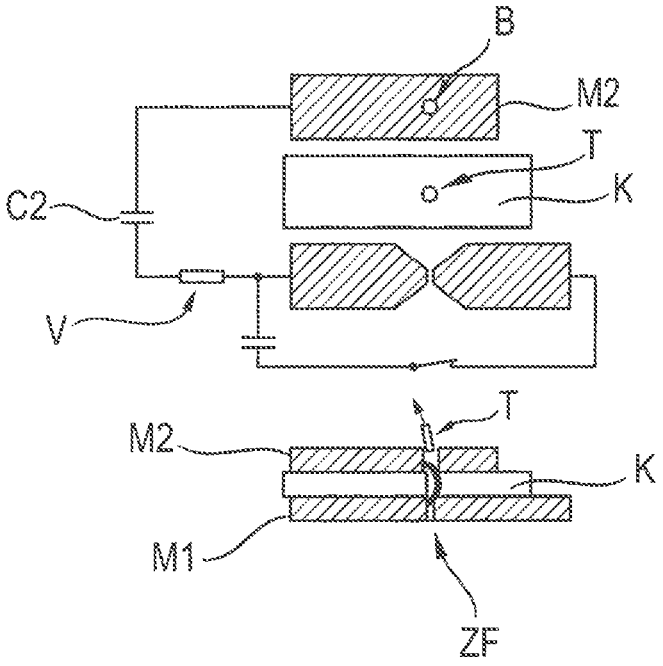
FIG. 1*c*: shows the ignition device of FIG. 1*a* in the ignition phase.

In FIGS. 1*a*, 1*b* and 1*c* a first exemplary embodiment is shown. Using FIG. 1*a*, in which the rest state of the ignition device is shown, the components of the ignition device first are described. The upper half of FIG. 1 shows the individual, mutually separated parts in a top view and also the external circuitry thereof in a simplified form. The lower half shows a section along the imaginary center line of the parts from the upper half and illustrates that together the parts form a compact component.

In detail, the ignition device comprises a first thin metal layer M1 and a further thin metal layer M2, between which a thin electrically insulating plastic layer K is disposed. Moreover, the first metal layer comprises another ignition bridge ZB of a known design. Exactly above the ignition bridge, a barrel B is disposed in the further metal layer M2. Below the same there is a sharp-edged through opening. Both metal strips are of a strip-shaped form and thus form longitudinal sides and narrow sides. The ignition bridge ZB of the exemplary embodiment thus divides the longitudinal sides approximately in the center thereof.

In the exemplary embodiment, the connections for the elements of the so-called trigger circuit, which essentially comprises or consists of a series circuit of the switch S and of a capacitor C1, are provided on the narrow sides of the first metal layer M1. In the rest phase the switch S is open, so that no current can flow in the trigger circuit. The capacitor is configured for operating voltages (<~1000 V) that are switchable by semiconductors and comprises a sufficient capacitance to evaporate the ignition bridge.

Moreover, a series circuit of the load V and of the ignition capacitor C2 is provided from the first metal strips M1 to the further metal strips M2. The load V is the element to be ignited, for example the ignition circuit of an explosive charge (EFI). The ignition capacitor C2 has a high operating voltage (>1000 V) and a corresponding high capacitance.

FIG. 1*b* shows the point in time at which the switch S is closed and the capacitor C1 can discharge. As a result, a suitable current flows and the ignition bridge ZB evaporates.

The situation shown in FIG. 1*c* then follows. Owing to the evaporation of the ignition bridge ZB, there is an enormous pressure that acts directly on the contacting plastic film K. The part T of the plastic film K is pressed upwards as a result and is punched out of the barrel B into the further metal layer M2 and accelerated through the barrel B, as can be clearly seen in FIG. 1*c*.

Owing to the narrow thickness of the plastic film K, there is at the same time an ignition spark ZF through the opening that has been left in the part T of the plastic film. As a result, the ignition circuit is closed by the high voltage switch via the two metal layers M1 and M2 and the capacitor C2 and the load V, and the load V is initiated.

Another embodiment of the present disclosure, but which operates according to the same principle, is represented in individual phases in FIGS. 2*a*, 2*b*, 2*c* and 2*d*. The figures are again divided into a representation of the individual components in a top view disposed in the upper half and a section along the imaginary center line of the components shown above in the lower half. The external circuitry with capacitors is also shown in the upper half.

The embodiment of the ignition device also comprises a first thin metal layer M12, which in turn comprises an ignition bridge ZB, and a further thin metal layer M22, which is separated from the first metal layer by a thin insulating plastic film K. A series circuit (trigger circuit) of the switch S and the capacitor C1 is connected to the two ends of the ignition bridge ZB.

Figure 2A:
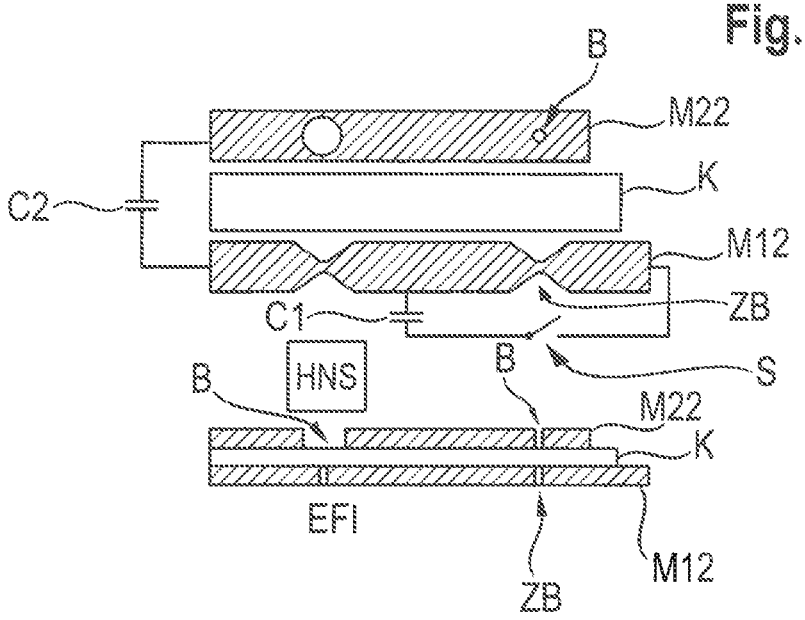
FIG. 2*a*: shows a further embodiment with integrated EFI in the rest phase.
Figure 2B:
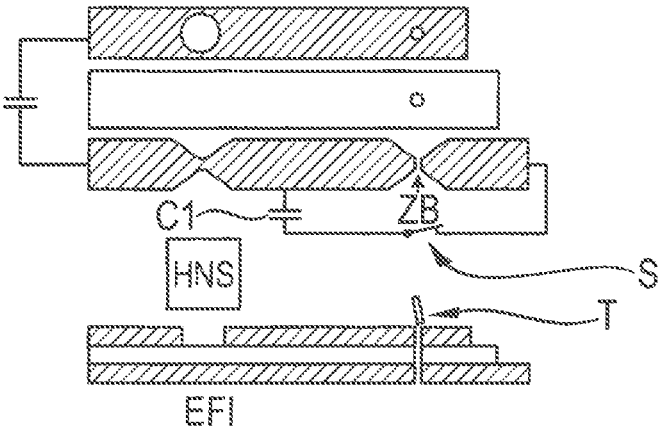
FIG. 2*b*: shows the ignition device of FIG. 2*a* in the first activation phase.

The situation immediately following the closure of the switch S is illustrated in FIG. 2*b*. The charging of the capacitor C1 causes the evaporation of the ignition bridge ZB. Owing to the pressure generated, in turn a part T of the plastic film K is punched out and accelerated through the barrel B.

Figure 2C:
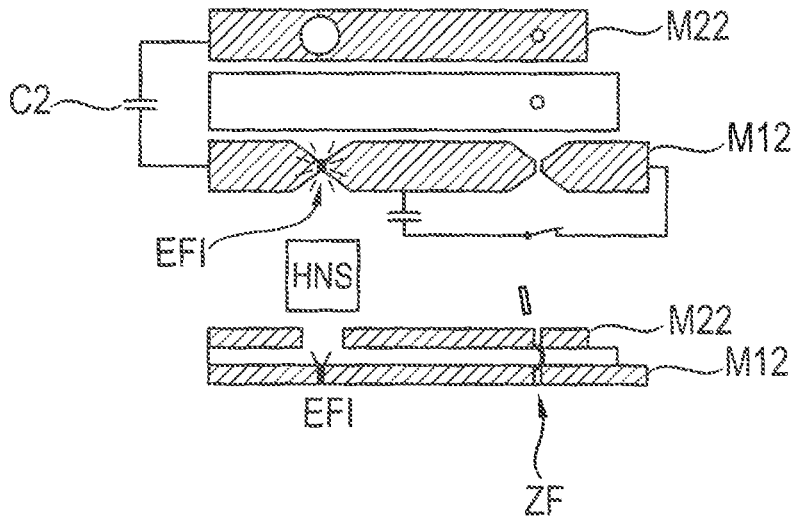
FIG. 2*c*: shows the ignition device of FIG. 2*a* in the second activation phase.
Figure 2D:
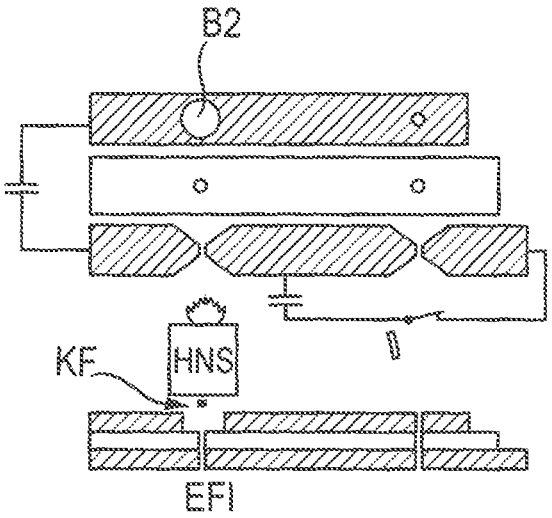
FIG. 2*d*: shows the ignition device of FIG. 2*a* in the ignition phase.

As shown in FIG. 2*c*, the ignition spark ZF can be formed owing to the opening punched out of the plastic film. As a result, the ignition circuit from the first metal film M12 via the capacitor C2 to the further metal film M22 is closed and the EFI (Exploding Foil Initiator) that is disposed in the first metal film M12 outside the trigger circuit is ignited.

The EFI also punches a plastic flyer KF out of the plastic film K. For this purpose, the further metal film M22 also comprises a component with the function B2 of a barrel that is disposed directly above the EFI. The plastic flyer KF is dimensioned regarding the dynamics thereof so that it can initiate the booster (secondary explosive, for example HNS) with the pulse thereof.

The embodiment described is represented by way of example and in a simplified form. In an implementation, it is provided to develop a design in which, in addition to the EFI and the booster in the form of an explosive pellet, the switch and the capacitor of the ignition circuit are also integral components of the ignition device according to the present disclosure.

The subject matter disclosed herein can be implemented in or with software in combination with hardware and/or firmware. For example, the subject matter described herein can be implemented in software executed by a processor or processing unit. In one exemplary implementation, the subject matter described herein can be implemented using a computer readable medium having stored thereon computer executable instructions that when executed by a processor of a computer control the computer to perform steps. Exemplary computer readable mediums suitable for implementing the subject matter described herein include non-transitory devices, such as disk memory devices, chip memory devices, programmable logic devices, and application specific integrated circuits. In addition, a computer readable medium that implements the subject matter described herein can be located on a single device or computing platform or can be distributed across multiple devices or computing platforms.

While at least one exemplary embodiment of the invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a", "an" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

REFERENCE CHARACTER LIST

M1, M12 first metal layer
M2, M22 further metal layer
K plastic layer
B, B2 barrel
T part (of the plastic layer)
KF plastic flyer
S switch
C1 capacitor (<300 V)
C2 capacitor (>1500 V)
V load
ZB ignition bridge
ZF ignition spark
EFI Exploding Foil Initiator
FL flyer
HNS booster (explosive pellet; secondary explosive)

The invention claimed is:

1. An ignition device for an explosive charge of an active body, the ignition device comprising:
- a first thin metal layer;
- a second thin metal layer that is parallel to the first thin metal layer;
- a thin plastic layer arranged between the first thin metal layer and the second thin metal layer, wherein the thin plastic layer is an electrically insulating layer; and
- a first ignition circuit comprising an ignition bridge and a first energy storage device connected in series on both sides of a switch; and
- a second ignition circuit comprising a second energy storage device and a load connected in series between a first end of the first thin metal layer and a first end of the second thin metal layer;
- wherein the first thin metal layer is physically separated from the second thin metal layer by the thin plastic layer, such that the first thin metal layer is not in contact with the second thin metal layer,
- wherein the ignition bridge is configured to evaporate when the switch is closed, and
- wherein the second ignition circuit is configured such that an evaporation of the ignition bridge causes a flow of electricity from the second energy storage device to trigger the load.

2. The ignition device of claim 1, wherein the thin plastic layer is configured such that the evaporation of the ignition bridge causes a short circuit between the first and second thin metal layers across the thin plastic layer.

3. The ignition device of claim 2, wherein the short circuit is caused by an opening formed in the thin plastic layer by a part of the thin plastic layer being punched out during the evaporation of the ignition bridge.

4. The ignition device of claim 3, wherein the short circuit comprises an ignition spark passing through the opening between the first and second thin metal layers.

5. The ignition device of claim 3, wherein the part of the thin plastic layer punched out is ejected from a barrel formed in the second thin metal layer, wherein the barrel is located opposite the ignition bridge relative to the thin plastic layer.

6. The ignition device of claim 5, wherein the barrel is disposed directly opposite the ignition bridge.

7. The ignition device of claim 1, wherein the ignition bridge is formed in the first thin metal layer.

8. The ignition device of claim 1, wherein the ignition bridge is configured to be evaporated by a flow of electricity across the ignition bridge when the switch is closed, the flow of electricity being generated from the first energy storage device.

9. The ignition device of claim 1, wherein the load is an ignition circuit of the explosive charge.

10. The ignition device of claim 1, wherein the first ignition circuit is a trigger circuit.

11. An ignition device for an explosive charge of an active body, the ignition device comprising:

a first thin metal layer;

a second thin metal layer that is parallel to the first thin metal layer;

a thin plastic layer arranged between the first thin metal layer and the second thin metal layer, wherein the thin plastic layer is an electrically insulating layer; and a first ignition circuit comprising an ignition bridge and a first energy storage device connected in series on both sides of a switch;

a second ignition circuit comprising the first thin metal layer, a second energy storage device, a load, and the second thin metal layer; and a secondary explosive, wherein the first thin metal layer is physically separated from the second thin metal layer by the thin plastic layer, such that the first thin metal layer is not in contact with the second thin metal layer, wherein the ignition bridge is configured to evaporate when the switch is closed, wherein the second ignition circuit is configured such that an evaporation of the ignition bridge causes a flow of electricity from the second energy storage device to trigger the load, and wherein the secondary explosive is configured to be triggered by a triggering of the load.

12. The ignition device of claim 11, wherein the thin plastic layer is configured such that the evaporation of the ignition bridge causes a short circuit between the first and second thin metal layers across the thin plastic layer.

13. The ignition device of claim 12, wherein the short circuit is caused by an opening formed in the thin plastic layer by a first part of the thin plastic layer being punched out during the evaporation of the ignition bridge.

14. The ignition device of claim 13, wherein the first part of the thin plastic layer punched out is ejected from a first barrel formed in the second thin metal layer, the first barrel being located opposite the ignition bridge relative to the thin plastic layer.

15. The ignition device of claim 14, wherein the ignition bridge and the load are integral to the first thin metal layer, wherein the first energy storage device is connected to the first thin metal layer between the ignition bridge and the load, wherein the short circuit allows a flow of electricity through the second ignition circuit, and wherein the load is configured to be triggered by the flow of electricity through the second ignition circuit.

16. The ignition device of claim 15, wherein the device is configured such that, when the load is triggered, a plastic flyer is punched out of the plastic layer and ejected from a second barrel formed in the second thin layer to initiate the secondary explosive, the second barrel being located opposite the load relative to the thin plastic layer.

17. The ignition device of claim 14, wherein the first barrel is disposed directly opposite the ignition bridge and the second barrel is disposed directly opposite the load.

18. The ignition device of claim 11, wherein the load is an exploding foil initiator (EFI).

19. A method of triggering an explosive charge of an active body using an ignition device, the method comprising:

providing a first thin metal layer on a first side of a thin plastic layer, which is electrically insulating;

providing a second thin metal layer on a second side of the thin plastic layer, so that the second thin metal layer is physically separated from the first thin metal layer by the thin plastic layer and the first thin metal layer is not in contact with the second thin metal layer;

forming a first ignition circuit by connecting an ignition bridge and a first energy source to a switch;

forming a second ignition circuit by connecting a second energy storage device between a load and the second thin metal layer;

triggering an evaporation of the ignition switch by closing the switch;

creating, by the evaporation of the ignition switch, an opening in the plastic layer at the ignition bridge;

closing the second ignition circuit via an ignition spark passing between the first and second thin metal layers through the opening; and triggering the load.

20. The method of claim 19, wherein the load and the ignition bridge are integral with the first thin metal layer, wherein the opening in the plastic layer is caused by ejecting a part of the plastic layer through a first barrel formed in the second thin metal layer, wherein the triggering of the load causes a plastic flyer to be punched out of the plastic sheet and to be ejected from a second barrel formed in the second thin metal layer, and wherein a secondary explosive is configured to be initiated by the plastic flyer.

* * * * *